US007444115B2

(12) United States Patent
Fukada et al.

(10) Patent No.: US 7,444,115 B2
(45) Date of Patent: Oct. 28, 2008

(54) TWO-SIDE IMAGE FORMING APPARATUS

(75) Inventors: Yasuaki Fukada, Yamatokoriyama (JP); Takashi Makiura, Nara (JP); Kiwamu Morita, Osaka (JP); Takashi Kubo, Kyoto (JP); Showtaro Okamoto, Nara (JP); Yoshiyuki Nagai, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 489 days.

(21) Appl. No.: 10/681,167

(22) Filed: Oct. 9, 2003

(65) Prior Publication Data

US 2004/0120744 A1 Jun. 24, 2004

(30) Foreign Application Priority Data

Oct. 10, 2002 (JP) ..... 2002-296892
Aug. 21, 2003 (JP) ..... 2003-297050

(51) Int. Cl.
*G03G 15/00* (2006.01)

(52) U.S. Cl. ..... 399/401; 399/364

(58) Field of Classification Search ..... 399/364, 399/401, 402, 361; 271/184, 301, 302
See application file for complete search history.

(56) References Cited

U.S. PATENT DOCUMENTS 4,307,958 A * 12/1981 McIrvine ..... 355/23
4,978,980 A * 12/1990 Noguchi et al. ..... 347/111
5,132,742 A * 7/1992 Goto ..... 399/401
5,225,881 A * 7/1993 Goto et al. ..... 399/402
5,448,348 A * 9/1995 Azeta ..... 399/364
5,839,032 A * 11/1998 Yasui et al. ..... 399/124
5,937,260 A * 8/1999 Taninaka et al. ..... 399/401
2003/0107765 A1 6/2003 Suzuki et al.

FOREIGN PATENT DOCUMENTS

JP 11-341231 A 12/1999
JP 2001-171884 A 6/2001

* cited by examiner

*Primary Examiner*—Anthony H. Nguyen
(74) *Attorney, Agent, or Firm*—Birch, Stewart, Kolasch & Birch, LLP

(57) ABSTRACT

A two-side image forming apparatus of the present invention is provided with a first sheet-transferring path, for use in one-side image formation, for transferring, to a printed sheet storage section via an image transcribing section, a sheet supplied from an unprinted sheet storage section; and a second sheet-transferring path, connected to the first sheet-transferring path, for supplying a tuned-over one-side printed sheet to the image transcribing section, the two-image forming apparatus being controlled so that a plurality of sheets are transferred concurrently in an overall sheet-transferring path when performing two-side image forming operation, the overall sheet-transferring path including the first sheet-transferring path and the second sheet-transferring path. With this arrangement, it is possible to attain a significant improvement in process efficiency.

17 Claims, 7 Drawing Sheets

FIG. 7

| | | PS ROLLER (R2) | FIRST SENSOR | INTERMEDIATE ROLLER (R2) | SECOND SENSOR | SWITCH-BACK SECTION | THIRD SENSOR | NOTES |
|---|---|---|---|---|---|---|---|---|
| ONE-SIDE PRINTING | | OFF<br>↓<br>ON<br>↓<br>OFF | OFF<br>↓<br>ON<br>↓<br>OFF | OFF | OFF | FORWARD ROTATION | OFF<br>↓<br>ON<br>↓<br>OFF | |
| TWO-SIDE PRINTING | STEP A FIRST SHEET (FRONT SURFACE) | OFF<br>↓<br>ON<br>↓<br>OFF | OFF<br>↓<br>ON<br>↓<br>OFF | OFF | OFF | FORWARD ROTATION | OFF<br>↓<br>ON | FROM supply of first sheet from storage section T1 into main transferring path through which first sheet is transferred to transcribing section,<br>TO reversing of transferring direction of first sheet by switch-back section after transcribing an image on front surface of first sheet. |
| | STEP B SECOND SHEET (FRONT SURFACE) | OFF<br>↓<br>ON<br>↓<br>OFF | OFF<br>↓<br>ON<br>↓<br>OFF | OFF<br>↓<br>ON<br>↓<br>OFF | OFF<br>↓<br>ON | BACKWARD ROTATION<br>FORWARD ROTATION | ON<br>↓<br>OFF<br>↓<br>ON | FROM transfer of first sheet from switch-back section into sub-transferring path,<br>TO stopping first sheet at PS rollers, and concurrently<br>FROM supply of second sheet from storage section T1 into main transferring path through which second sheet is transferred to transcribing section,<br>TO reversing of transferring direction of second sheet by switch-back section after transcribing an image on front surface of second sheet. |
| | STEP C FIRST SHEET (BACK SURFACE) | OFF<br>↓<br>ON<br>↓<br>OFF | OFF<br>↓<br>ON<br>↓<br>OFF | OFF<br>↓<br>ON<br>↓<br>OFF | ON<br>↓<br>OFF<br>↓<br>ON | BACKWARD ROTATION<br>FORWARD ROTATION | ON<br>↓<br>OFF<br>↓<br>ON<br>↓<br>OFF | FROM transfer of second sheet from switch-back section into sub-transferring path,<br>TO Stopping second sheet at PS rollers, and concurrently<br>FROM transfer of first sheet from the PS rollers via sub-transferring path to main transferring path,<br>TO delivery-out of first sheet via switch-back section to storage section T2 after transcribing an image on back surface of first sheet. |
| | STEP D SECOND SHEET (BACK SURFACE) | OFF<br>↓<br>ON<br>↓<br>OFF | OFF<br>↓<br>ON<br>↓<br>OFF | ON<br>↓<br>OFF | ON<br>↓<br>OFF | FORWARD ROTATION | OFF<br>↓<br>ON<br>↓<br>OFF | FROM transfer of second sheet from the PS rollers via sub-transferring path to main transferring path,<br>TO delivery-out of second sheet via switch-back section to storage section T2 after transcribing an image on back surface of second sheet. |
| | STEP E<br>: | REPEAT STEPS A TO D | | | | | | |

TWO-SIDE IMAGE FORMING APPARATUS

This Nonprovisional application claims priority under 35U.S.C. §119(a) on Patent Application No(s). 2002-296892 and 2003-297050 filed in Japan on Oct. 10, 2002 and Aug. 21, 2003, the entire contents of which are hereby incorporated by reference.

FIELD OF THE INVENTION

The present invention relates to a two-side image forming apparatus for forming an image on both sides of paper (sheet), especially to a two-side image forming apparatus capable of performing a high-speed image forming process

BACKGROUND OF THE INVENTION

As a conventional image forming apparatus for printing on both sides of paper, an image forming apparatus disclosed in Japanese Publication of Unexamined Patent Application, Tokukaihei, No. 11-341231 (JP 11-341231; published on Dec. 10, 1999) is known, for example. As shown in FIG. 1 of the publication, the two-side image forming apparatus is provided with a transcription drum for transcribing, on a sheet, an image that is read by an image reading section 1*a*. When transcribing the image on the surface of the sheet P, a sheet P sent from a sheet stock section 5 to a main transferring path (an example of a first sheet-transferring path) 6 passes by a transcribing section provided in vicinity of the transcribing drum 19, whereby the image is transcribed on a surface of the sheet. The thus transcribed image is fixed on the surface of the sheet by a fixing roller 23. The sheet on which the image is fixed, is held by switch-back rollers 10, which rotate forwardly (normal rotation), and is transferred so that an rear end of the sheet is held by the switch-back rollers 10.

Then, the switch-back roller 10 rotates backwardly (reverse rotation) so as to enter the sheet P into a sub-transferring path (an example of a second sheet-transferring path). Then, the sheet P is transferred by a transferring roller 11 provided in the sub-transferring path 8, so as to enter the sheet P into the main transferring path 9 again. Turn-over of the sheet P is carried out by entering the sheet P into the sub-transferring sheet 8 by using the reverse rotation of the switch-back roller 10, and then reentering the sheet P into the main transferring path 6 from the sub-transferring path 8. The turn-over causes a reverse surface of the sheet p to face the transcribing drum 19. Therefore, it is possible to transcribe the image on the reverse surface of the sheet P passing along the main transferring path 6.

After the image is transcribed onto both the sides of the sheet P, the sheet P is delivered out into a deliver-out tray 12 by normal rotation of the switch-back roller 10.

According to the conventional two-side image forming apparatus described in JP 11-341231 having the above-mentioned arrangement, two-side printing is carried out by continuous transfer of sheets thereby attaining a shorter process time. Further, the use of the sub-transferring path, which requires only small area, leads to miniaturization of the apparatus.

In the conventional two-side image forming apparatus, however, only one sheet is transferred through both the main transferring path 6 and the sub-transferring path 8 during the two-side printing of one sheet. Thus, it is not possible to carry out the two-side printing by printing plural sheets parallel. In this point, the conventional two-side image forming apparatus has a problem in printing efficiency.

It is conceived to improve the printing efficiency of the two-side printing by transferring plural sheets parallel during the printing. Japanese Publication of Unexamined Patent Application, Tokukai, No. 2001-171884 (published on Jun. 26, 2001) discloses an image forming apparatus in which a sheet (following sheet) is entered into a turning-over path while a sheet (followed sheet) entered before the sheet is passing along the turning-over path. In this method, the following sheet enters into the turning-over path after the followed sheet reaches leading means for leading a turned-over sheet to a backward transferring path.

However, this method cannot improve the printing efficiency sufficiently and fails to respond to a need to improve efficiency in complete sheet transfer including reversing of sheet for printing both surfaces of the sheet. Thus, there is a demand for a two-side image forming apparatus for printing plural sheets with more efficient sheet transfer of the plural sheets without causing sheet-jamming in the sheet transfer.

SUMMARY OF THE INVENTION

The present invention has an object to provide a two-side image forming apparatus having a main transferring path and a sub-transferring path, and capable of attaining a significant improvement in process efficiency.

In order to attain the object, a two-side image forming apparatus of the present invention is provided with a first sheet-transferring path, for use in one-side image formation, for transferring, to a printed sheet storage section via an image transcribing section, a sheet supplied from an unprinted sheet storage section; and a second sheet-transferring path, connected to the first sheet-transferring path, for supplying a tuned-over one-side printed sheet to the image transcribing section, the two-image forming apparatus being controlled so that a plurality of sheets are transferred concurrently (parallel) in an overall sheet-transferring path when performing two-side image forming operation, the overall sheet-transferring path including the first sheet-transferring path and the second sheet-transferring path.

With this arrangement, plural sheets are concurrently transferred in the first and second sheet-transferring paths overall. Thus, this arrangement attains a significant improvement in process efficiency compared with a conventional arrangement capable of processing only one sheet at a time.

For a fuller understanding of the nature and advantages of the invention, reference should be made to the ensuing detailed description taken in conjunction with the accompanying drawings.

BRIEF DESCRIPTION OF THE DRAWINGS

FIG. 7 is a table for showing operation of respective sections of the two-side image forming apparatus.

DESCRIPTION OF THE EMBODIMENTS

Figure 1:
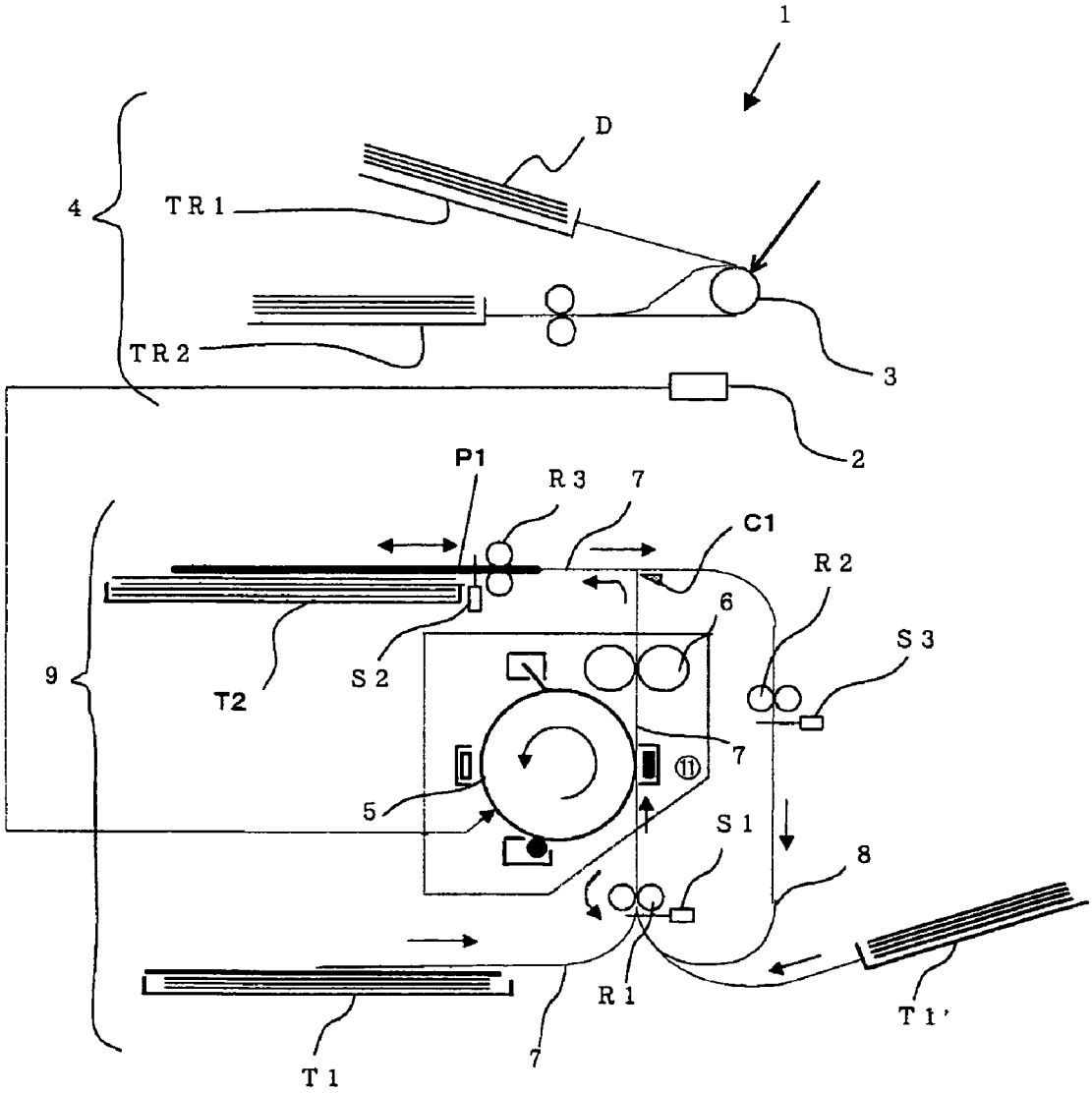
FIG. 1 is a schematic cross-sectional view for providing detailed explanation mainly on an arrangement of an image forming section of a two-side forming apparatus of an embodiment of the present invention.
Figure 5:
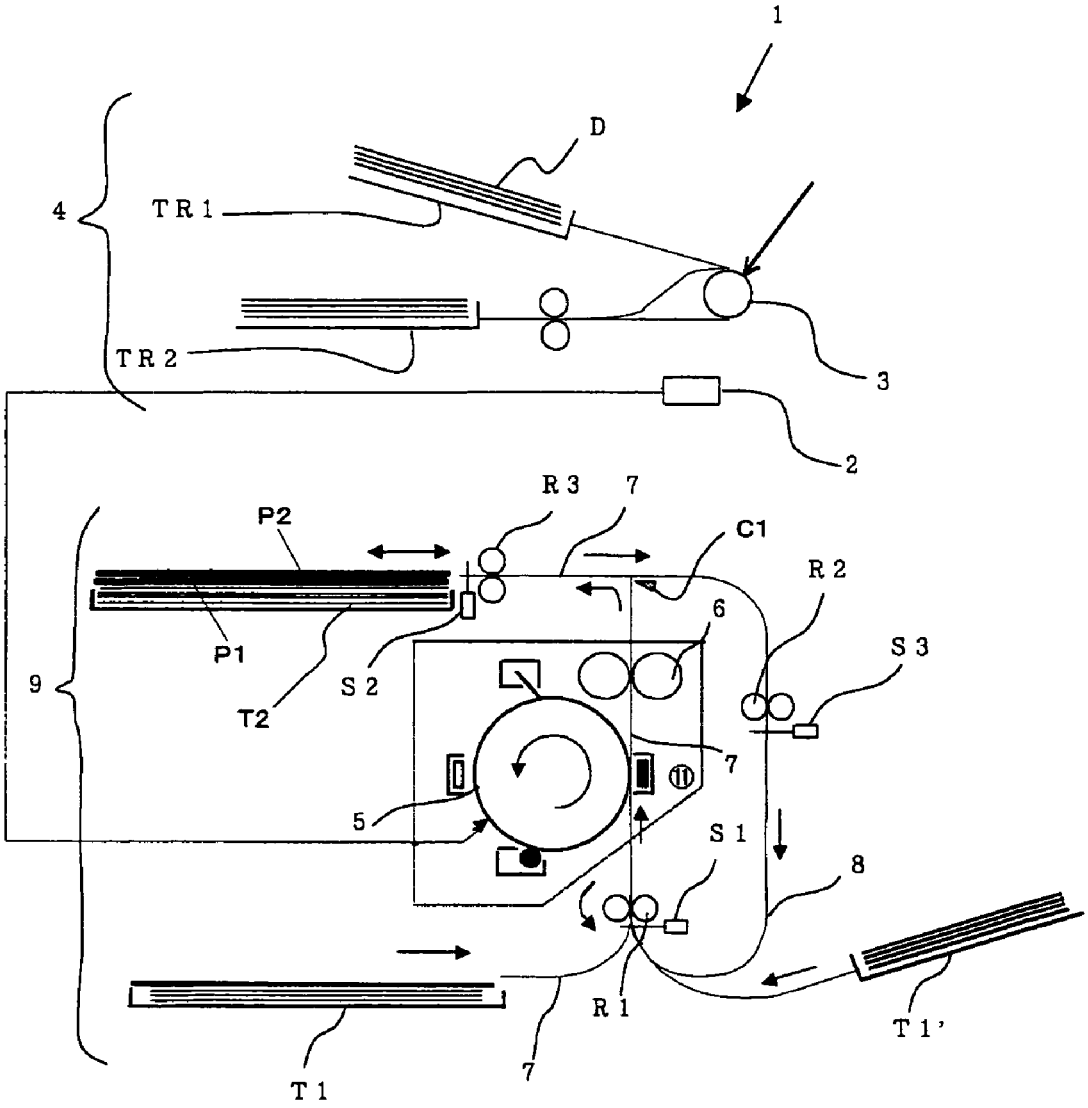
FIG. 5 is a similar cross-sectional view for explaining the processing procedure in detail.
Figure 6:
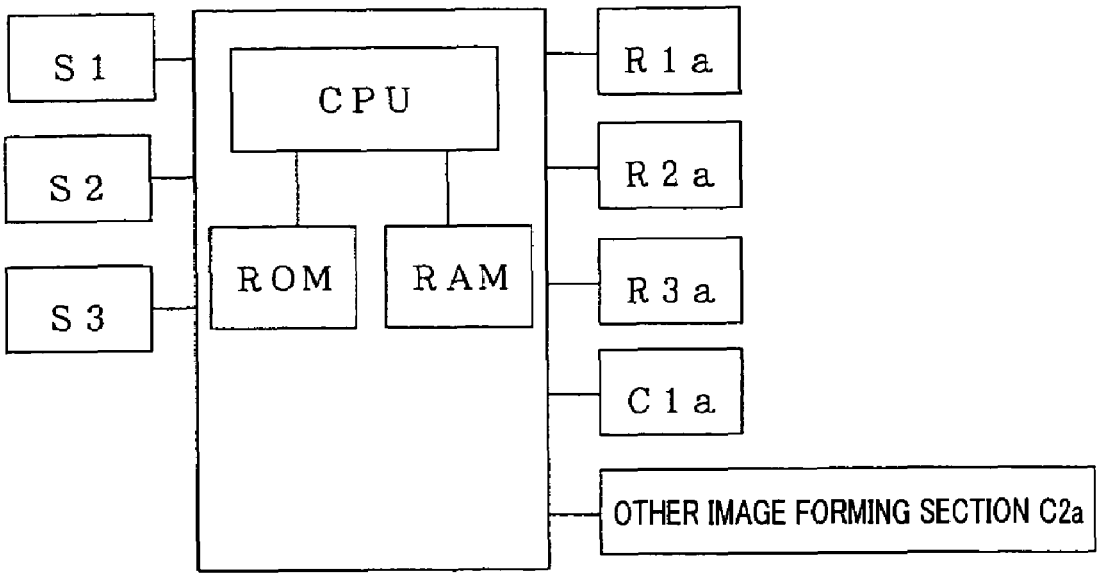
FIG. 6 is a control block diagram of the two-side image forming apparatus.

A embodiment of the present invention is described below, referring to drawings. FIG. 1 is a cross-sectional view for providing detailed explanation mainly on an arrangement of an image forming section of a two-side forming apparatus of the embodiment of the present invention, whereas FIGS. 2 to 5 are similar cross-sectional views for explaining processing procedure in detail. FIG. 6 is a control block view of the two-side image forming apparatus. FIG. 7 is a table for showing operation of sections of the two-side image forming apparatus.

As shown in FIG. 1, a two-side image forming apparatus 1 of the present embodiment is provided with an image reading section 4 and an image forming section 9, which are later described.

The image reading section 4 is provided with a roller 3 and a CCD (Charge Coupled Device) sensor 2. A document D supplied from a document tray TR1 is backwardly (in a reverse manner) transferred by the roller 3, and the CCD sensor 2 reads an image of the document D in a way to the document delivery-out tray TR2.

The image forming section 9 is provided with, essentially, a transcribing drum (image transcribing apparatus) 5, a main transferring path (an example of a first sheet-transferring path) 7, a switch-back section (switch-back means) R3, PS (Paper Stop) rollers R1, a sub-transferring path (an example of a second sheet-transferring path) 8, a path-switching section C1, and intermediate rollers R2. On the transcribing drum 5, an electrostatic latent image is formed in accordance with image data thus read out by the CCD sensor 2. A sheet is supplied from unprinted sheet stock section T1 for storing sheets for transcription, and then is transferred through the main transferring path 7. The main transferring path 7 transfers the sheet from (a) the unprinted sheet stock section T1, via (b) a transcribing section provided in vicinity of the transcribing drum 5 and (c) fixing rollers 6, to a printed sheet stock T2. The switch-back section R3 includes switch-back rollers and the like provided in an immediate upstream of the printed sheet stock section T2, in the main transferring path 7. The PS rollers R1, which are provided in the main transferring path 7, are located in an immediate upstream of the transcription drum 5. The sub-transferring path 8 is branched off from the main transferring path 7 in an upstream of the switching-back section R3, and is merged in the main transferring path 7 in an upstream of the PS rollers R1. The path-switching section C1 is provided at a diverging section at which the main transferring path 7 and the sub-transferring path 8 are diverged. The immediate rollers R2 are provided in the sub-transferring path 8. Note that the PS rollers R1 adjust a timing for when the transfer of the sheet to the main transferring path 7 starts, in order to match a position of the image on the transcribing drum 5 with a transcribing position (to which the image is transcribed) on the sheet.

Moreover, a first sheet sensor S1 is provided in the main transferring path 7 and located in an immediate upstream of the PS rollers R1, a second sheet sensor S2 is provided right after the switch-back section R3 and between the switch-back section R3 and the printed sheet storage section T2. In the sub-transferring path 8, a third sheet sensor S3 is provided in an immediate downstream of the intermediate rollers R2.

Of course, the image forming section 9 is provided with other image forming constituent elements C2 including a main charger, a cleaning apparatus, and the like, around the transcribing drum 5. However, explanation of those sections is omitted here, as the present invention can be well described without the explanation.

Each element are connected as shown in FIG. 6. In order to control the transfer of the sheets, which is later described, the first to third sheet sensors S1 to S3 are connected to an input section of a control section 12 provided with a CPU, a ROM for storing a program, a RAM for temporally storing data. To an output section of the control section 12, a driving section R1*a* for driving the PS rollers, a driving section R2*a* for driving the intermediate rollers R2, a driving section R3*a* for driving the switch-back section R3, a driving section C1*a* for driving the path-switching section C1, and a driving section C2*a* for driving other image forming element are respectively connected.

Next, the following explains, referring to FIGS. 1 to 7, processing procedure of the control section 12 for two-side image forming process of the two-side image forming apparatus 1 of the present embodiment.

To begin with, general one-side image forming process is explained. In the one-side image forming process, an electrostatic latent image is formed around the transcribing drum 5 in accordance with a signal sent from the CCD sensor 2. The electrostatic latent image is visualized with toner by a developing section. The visualized image is transferred to the transcribing section by rotation of the transcribing drum 5. In accordance with the formation of the image, the control section 12 stops (turns OFF) the PS rollers R1 and the intermediate rollers R2 and rotates (turns ON) the switch-back section R3 forwardly, as shown in the row "One-side Printing" of FIG. 7. While those rollers are controlled as such, the control section 12 drives a sheet supplying roller in the other image forming element C2 so as to supply, to the main transferring path 7, a sheet stored in the unprinted sheet storage section T1. When the sheet passes the first sensor S1, the first sensor S1 sends a sheet detection signal to the control section 12. On receipt of the sheet detection signal from the first sensor S1, the control section 12 starts rotating the PS rollers R1 after a predetermined period. Thereby, the sheet passes by the transcribing section provided in the vicinity of the transcribing drum 5, so that the image is transcribed on the sheet.

The thus transcribed image is fixed when the sheet passes by the fixing rollers 6. At this moment, the control section 12 causes the path-switching section C1 to switch to the switch-back section R3 so that the sheet in transfer is transferred to the switch-back section R3. In this way, the sheet is delivered to the switch-back section R3 that is forwardly rotating (normal rotation). The switch-back section R3 transfers the sheet to the printed sheet storage section T2. After the sheet is delivered out into the printed sheet storage section T2, the control section 12 stops rotating the PS rollers R1 and the switch-back section R3.

The one-side printing process is completed as such. If there are more than two sheet to print, the above process is repeated.

Next, the two-side printing process is explained. In the present embodiment, images of a first document, a third document, a second document and a fourth document are read in this order (the images of the respective documents are formed respectively on a front surface of a first sheet P1, a front surface of a second sheet P2, and a reverse surface of the first sheet P1 and a reverse surface of the second sheet P2). Documents can be read in his kind of order various methods. For example, after reading the first document, the second document is caused to pass by the reading second without being read, and sent away from the reading section. Then, the third document is transferred thereto and read. After the third document is read, the third document is sent away from the reading section, and then the second document, which has been sent away, is transferred to the reading section and read. After the second document is read, the fourth document is read. A method described in JP 11-341231 is another example. However, the characteristics of the present invention does not lie in how to read documents, but in how to form the images. Thus, the detail of how to read documents is not explained here.

In the two-side printing, an electrostatic latent image of the image of the first document (the image to be printed on the front surface of the first sheet P1) is formed around the transcribing drum 5 in accordance with the signal sent from the CCD sensor 2. The image is visualized with toner by the developing section and is transferred the transcribing section by the rotation of the transcribing drum 5. When the image is formed, the control section 12 stops (turns OFF) the PS rollers R1 and the intermediate rollers R2, and rotates (turns ON) the switch-back section R3 forwardly, as shown in STEP A in the row "Two-side Printing" in FIG. 7. While those rollers are controlled as such, the control section 12 drives the sheet supplying roller in the other image forming element C2 so as to supply, to the main transferring path 7, the first sheet P1 stored in the unprinted sheet storage section T1. When the first sheet P1 passes by the first sheet sensor S1, the first sheet sensor S1 sends a sheet detection signal to the control section 12. On receipt of the sheet detection signal from the first sheet sensor S1, the control section 12 starts rotating the PS rollers after a predetermined period. Thereby, the first sheet P1 passes by the transcribing section provided in the vicinity of the transcribing drum 5, so that the image of the first document is transcribed on the front surface of the first sheet P1. After the transcription is completed, the control section 12 stops the PS rollers R1.

The thus transcribed image is fixed when the first sheet P1 passes by the fixing rollers 6. At this moment, the control section 12 causes the path-switching section C1 to switch to the switch-back section R3 so that the sheet in transfer is transferred to the switch-back section 3. In this way, the first sheet P1 is delivered to the switch-back section R3 that is forwardly rotating (normal rotation). The switch-back section R3 transfers the first sheet P1 to the printed sheet storage section T2. The first sheet P1 that passes by the switch-back R3 is detected by the sheet sensor S2.

Note that the switch-back section R3 is a pair of rollers capable of rotating forwardly and backwardly, and is provided at an immediate upstream of the printed sheet storage section T2, in the main transferring path 7. The switch-back means R3 can supply a printed sheet to the sub-transferring path 8. The switch-back section R3 having such an arrangement performs both the transfer of the printed sheet into the sub-transferring path 8 and the transfer thereof into the printed sheet storage section T2. Thus, use of such switch-back section R3 contributes to simplification of the overall apparatus.

Then, as shown in Step B, the control section 12 rotates the switch-back section R3 backwardly after a predetermined period since reception of a sheet detection signal from the sheet sensor S2. (The backward rotation (reverse rotation) of the switch-back section R3 backwardly transfers the first sheet P1 whose rear end is held by the switch-back section R3.) At the same time, the control section 12 also causes the path-switching section C1 to switch to (turn over to) the sub-transferring path 8, so that the first sheet P1 is transferred from the switch-back section R3 to the sub-transferring path 8. Further, the control section 12 starts rotating the intermediate rollers R2, which has been stopped by then. The first sheet P1 shown in FIG. 1 shows where the first sheet P1 is when the switch-back section R3 is backwardly rotated.

Figure 2:
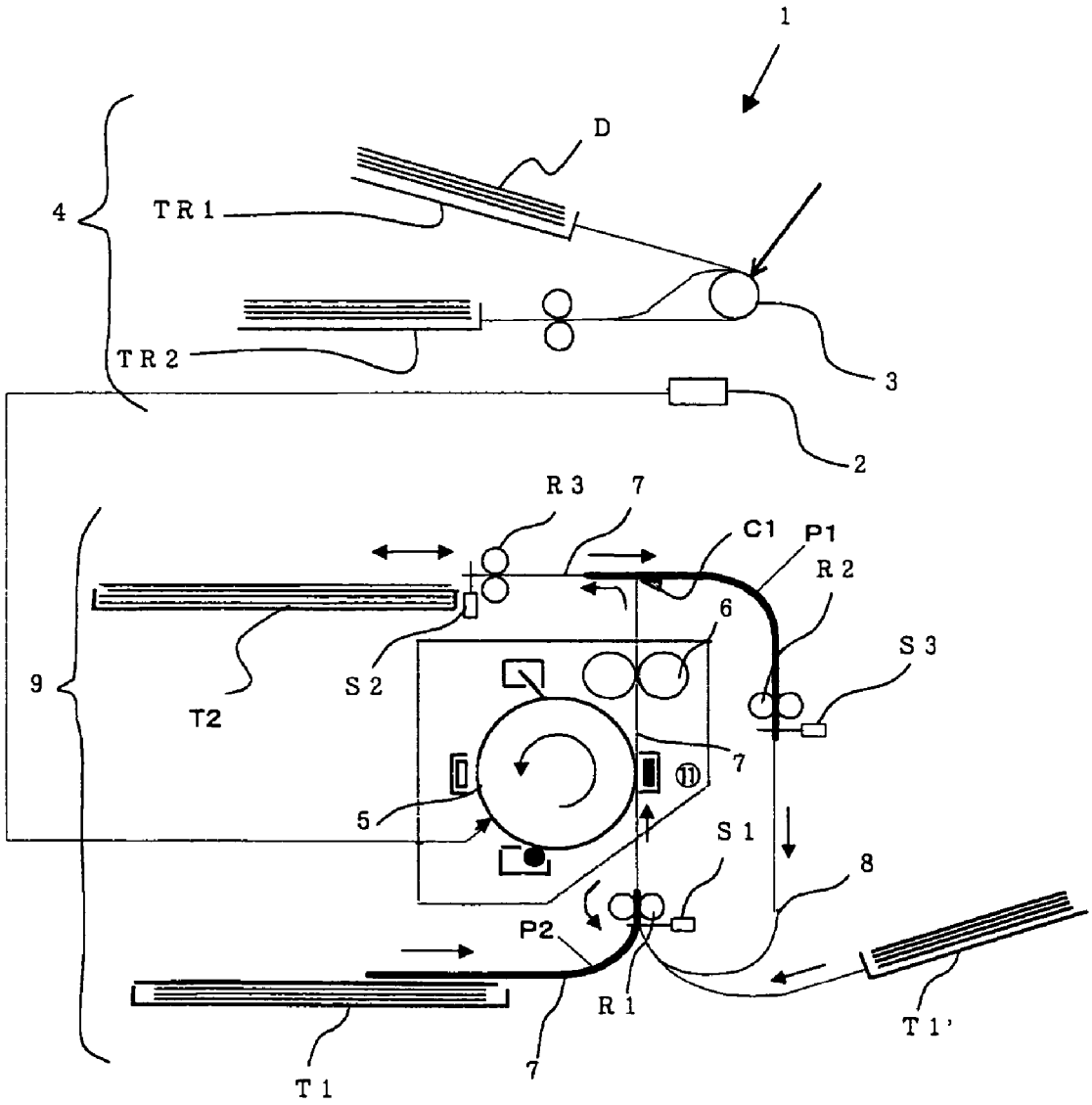
FIG. 2 is a similar cross-sectional view for explaining processing procedure in detail.

Then, the first sheet P1 is transferred to the switch-back section R3 and then to the sub-transferring path 8. When a front end (with respect to its transferring direction) of the first sheet P1 reaches the intermediate rollers R2, which is located in the sub-transferring path 8 and starts rotating, the first sheet P1 is held by the intermediate rollers R2 and transferred through the sub-transferring path 8. After the front end of the first sheet P1 passes by the intermediate rollers R2, the sheet sensor S3 provided in the intermediate downstream of the intermediate rollers R2 detects the passing of the first sheet P1. Upon receipt of a sheet detection signal from the sheet sensor S3, the control section 12 stops rotating the intermediate rollers R2 after a predetermined period, and stops the transfer of the first sheet P1. FIG. 2 illustrates where the first sheet P1 is in this state. Thereby, the first sheet P1 that enters into the sub-transferring path 8 is stopped in the sub-transferring path 8 while being held by its rear end (that is, its front end with respect to the transferring direction) by the intermediate rollers R2. Moreover, at this moment, the switch-back section R3 is forwardly rotated.

After the first sheet P1 is sent to the switch-back section R3, the image of the third document (the image to be transcribed on the front surface of the second sheet P2) is sent from the CCD sensor 2 to the transcribing drum 5, and is visualized on the transcribing drum. In synchronism of the reading of the third document, the control section 12 drives the sheet driving roller in the other image forming element C2, so as to supply, to the main transferring path 7, the second sheet P2 stored in the unprinted sheet stock section T1. When the second sheet P2 passes by the first sheet sensor S1, the first sensor S1 sends a sheet detection signal to the control section 12. Upon receipt of the sheet detection signal from the first sensor S1, the control section 12 stops the PS rollers R1 after rotating the PS rollers R1 for a predetermined period, so that the second sheet P2 is stopped in the main transferring sheet 7 with a front end thereof held by the PS rollers R1. FIG. 2 illustrates this state.

In the two-side image forming apparatus, as described above, the two-side image forming operation is performed with plural sheets transferred at once in the main-transferring path 7 and the sub-transferring path 8. Because of this, the two-side image forming apparatus has a significantly improved efficiency in the two-side image forming process.

Rotation of the intermediate rollers R2 and the PS rollers R1 is stopped until both of the first sheet P1 and the second sheet P2 are respectively held by the intermediate rollers 2 and the PS rollers R1, that is, until the sensors S3 and S1 respectively send the sheet detection signals and both the intermediate rollers R2 and the PS rollers R1 are stopped. When the control section 12 receives both the sheet detection signals, the control section 12 resumes the rotation of each of the intermediate rollers R2 and the PS rollers R1, so that the second sheet P2 passes by the transcribing section provided in the vicinity of the transcribing drum 5 and the image of the third document is transcribed on the front surface of the second sheet P2.

The thus transcribed image is fixed when the second sheet P2 passes by the fixing rollers 6. At this moment, the control section 12 causes the path-switching section C1 to switch to the switch-back section R3 so that the sheet in transfer is transferred to the switch-back section R3. Thereby, the second sheet P2 is transferred to the switch-back section R3 that is rotating forwardly, and is transferred to the printed sheet storage section T2 by the switch-back section R3. Then, when the second sheet P2 passes by the switch-back section R3 and is detected by the sheet sensor S2, the control section 12 backwardly rotates the switch-back section R3 after a predetermined period since reception of a sheet detection signal from the sheet sensor S2, and switches over the path-switching section C1. If the path-switching section C1 is such a path-switching section that does not need turning over to switch over the transfer of the sheet, it is possible to omit the driving the path-switching section C1.

Figure 3:
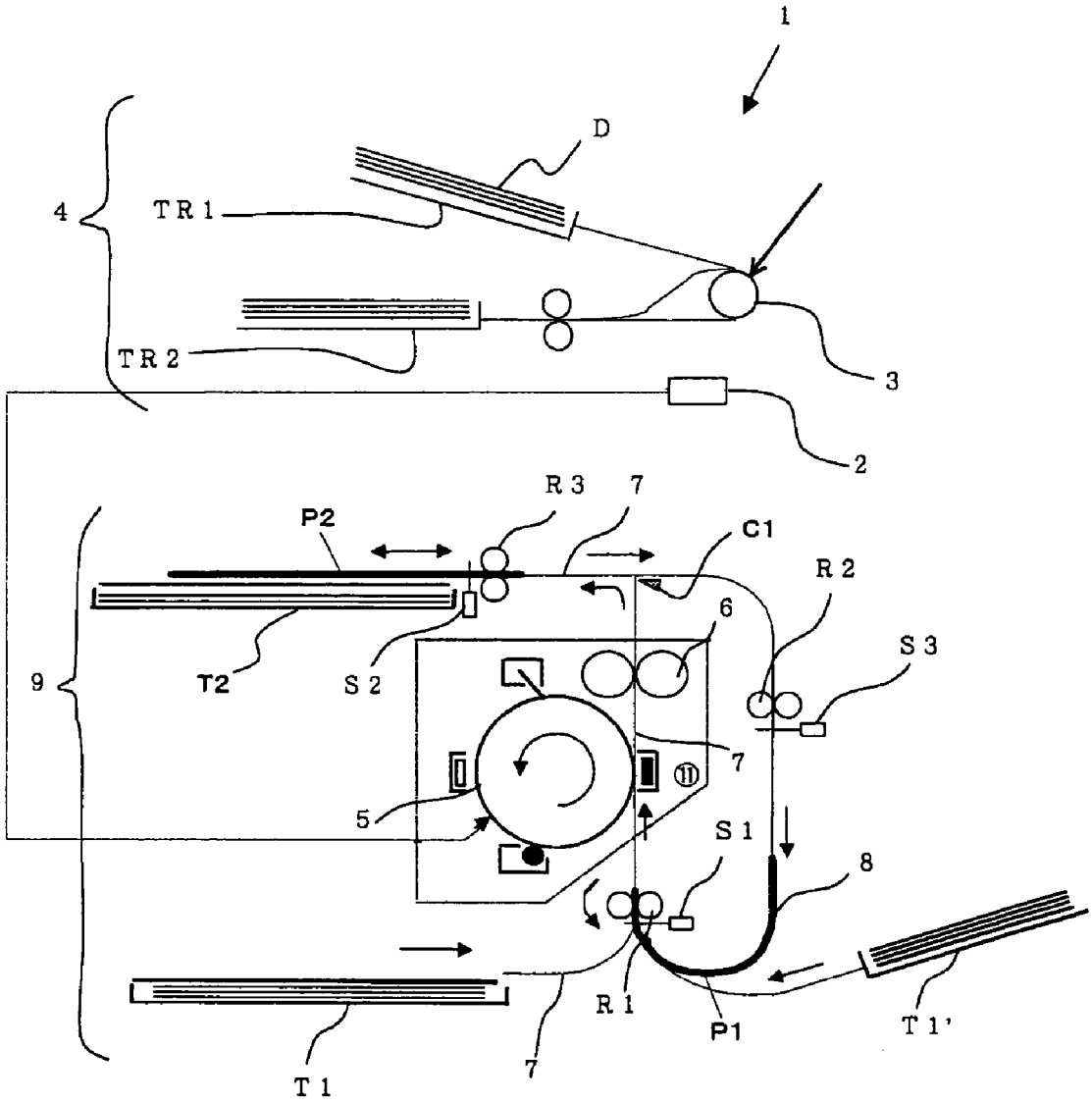
FIG. 3 is a similar cross-sectional view for explaining the processing procedure in detail.
Figure 4:
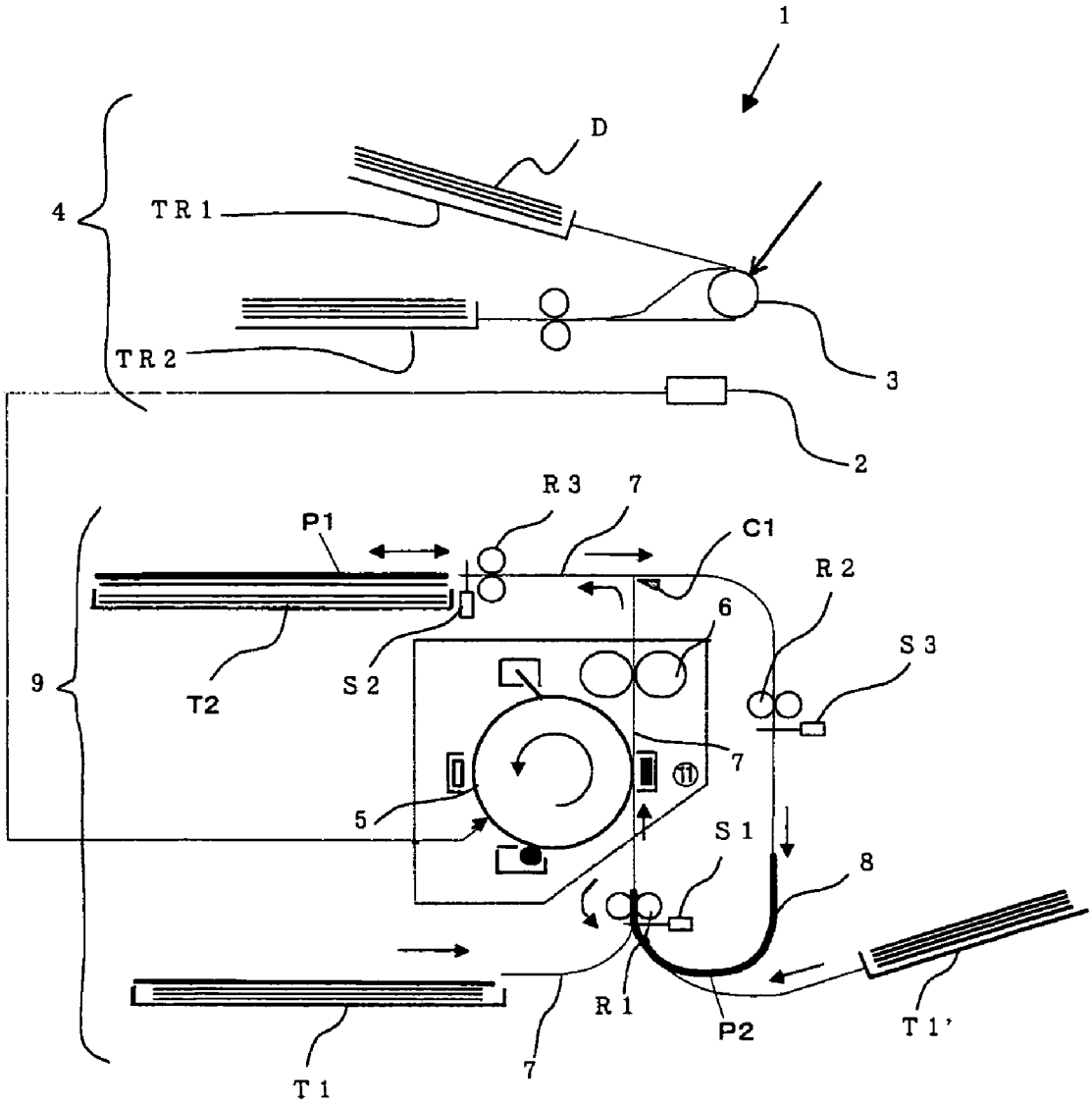
FIG. 4 is a similar cross-sectional view for explaining the processing procedure in detail.

Here, the first sheet P1 passes along the sub-transferring path 8 by the rotation of the intermediate rollers R2, the rotation being in synchronism with the resume of the rotation of the PS rollers R1. Then, as in FIG. 2, the rotation of the intermediate rollers R2 is stopped when the first sheet P1 reaches the PS rollers R1. FIG. 3 illustrates the states of the first sheet P1 and the second sheet P2 that have been thus transferred and subjected the printing process.

When the respective sheets as shown in FIG. 2 are transferred to be as shown in FIG. 3, it should be arranged that the first sheet P1 and the second sheet P2 do not overlap each other. For this reason, it should be arranged that L1<L2, where L1 is a longest sheet length along the transferring direction the two-side image forming apparatus can deal with, and L2 is a distance from the third sheet sensor S3 to the PS rollers R1 along the sub-transferring path 8. If not L1<L2, a front part of the first sheet P1 that is being transferred by the intermediate rollers R2, overlaps on the second sheet P2 that is being supplied from the sheet supplying section T1, during the operation in which the PS rollers R1 and the intermediate rollers R2 are rotated in synchronism with each other.

Moreover, it is important to arrange such that a rear end of the first sheet that is being transferred by the switch-back section R3, does not interfere with a front end of the second sheet P2 that is being transferred to the switch-section R3 via the main transferring path 7. For this reason, it should be arranged such that L1<L3, where L3 is a distance from the PS rollers R1 to the switch-back section R3 along the main transferring path 7.

Further, if the sub-transferring path 8 is not long enough to deal with the largest possible sheet to be used, the first sheet P1 and the second sheet P2 interfere with each other at the path-switching section C1 or in an area where the PS rollers R1 are located. It is necessary to arrange such that such interference will not occur. Such interference will not occur when L1<L4, where L4 is a distance from (a) a crossing point between the sub-transferring path 8 and the downstream part of the main transferring path 7 with respect to the transcribing section, to (b) the PS rollers R1, along the sub-transferring path 8 (that is, the whole length of the sub-transferring path 8). As long as those conditions are satisfied, the sheets in transfer will not interfere with each other.

In this way, the second sheet P2 is transferred to the switch-back section R3 that is forwardly rotating, and then, the second sheet P2 is transferred to the printed sheet storage section T2 from the switch-back section R3. The second sheet P2 passing by the switch-back section R3 is detected by the second sensor S2. Similarly to the case of the first sheet 1 shown in FIG. 1, the switch-back section R3 is backwardly rotated after a predetermined period since reception of a sheet detection signal from the second sensor S2. Thereby, as shown in step 3, the second sheet P2 is transferred into the sub-transferring path 8. When a front end of the second sheet P2 thus transferred into the sub-transferring path 8 is detected by the third sheet sensor S3, the intermediate rollers R2 are stopped. Then, the second sheet P2 is stopped in the sub-transferring path 8 while being held by the intermediate rollers R2.

While the first sheet is in the sub-transferring path 8, the second sheet reaches the switch-back section R3. Thereby, two sheets are transferred at once (concurrently) in the main transferring path 7 and the sub-transferring path 8 overall. This significantly improves the image forming process.

Here, the first sheet P1 is stopped in the sub-transferring path 8 while being held by the PS rollers R1, and the second sheet P2 is held by the intermediate rollers R2. At this moment, if it is detected by the first sheet sensor S1 and the third sheet sensor S3 that the first sheet P1 and the second sheet P2 are respectively held by the rollers R1 and R2, the control section 12 resumes the rotation of the PS rollers R1, whereby the first sheet P1 passes by the transcribing section provided in the vicinity of the transcribing drum 5, so that the image of the second document is transcribed on the reverse surface of the first sheet P1.

Then, the thus transcribed image is fixed when the first sheet P1 passes by the fixing rollers 6. Then, the first sheet P1 is transferred to the printed sheet storage section T2. In accordance with this transfer of the first sheet P1, the second sheet P2, which has been stopped at the intermediate rollers R2, is transferred through the sub-transferring path 8 by the intermediate rollers R2 rotating in synchronism with the resume of the rotation of the PS rollers R2 and reaches to the PS rollers R1 (See FIG. 4), as described above.

Then, in step D, by the rotation of the PS rollers R1, the second sheet P2 is transferred to the transcribing section after taking timing with the image to be transcribed thereon, Then, the image of the fourth document is transcribed on the reverse surface of the second sheet P2, and is delivered out to the printed sheet storage section T2. FIG. 5 illustrates the state in which the transfer and the printing process of the first sheet P1 and the second sheet P2 have been completed. The images of the first and second documents have been printed respectively on the front and reverse surfaces of the first sheet P1. The first sheet P1 is delivered out to the printed sheet storage section T2.

If the sheets in even numbers are to be processed, the two-side printing process is performed by repeating steps A to D shown in FIGS. 1 to 5 and 7.

If the sheets in odd numbers are to be processed, the control section 12 turns over the path-switching section C1 after repeating steps A to D more than once or after completion of step D (FIG. 5 shows the state after completion of step D). Then, the control section 12 supplies a last sheet (odd-numbered sheet) from the unprinted sheet storage section T1 to the main transferring path 7. Then, an image is transcribed on one side of the last sheet by the transcribing section, and fixed thereon by the fixing rollers. After the fixing, the last sheet is transferred from the main transferring path 7 to the sub-transferring path 8 via the path-switching section C1 thus turned over. Then, the control section 12 turns over the path-switching section C1 again. Then, the sheet that enters into the sub-transferring path 8 is transferred through the main transferring path again without stopping the sheet by the intermediate rollers 2. Then, an image is transcribed and fixed on a reverse surface of the last sheet. After that, the last sheet is transferred to printed sheet storage section T2 via the switch-back section R3. In this way, the two-side printing of the last sheet of the sheets in odd number is completed. Note that only one sheet is dealt with in the overall transferring path when the last sheet is being processed.

In the above-discussed embodiment, the main transferring path 7, the sub-transferring path 8 and the switch-back section R3 respectively include sheet transfer driving sections, which are independently driven by different driving sources. With this arrangement, it is possible to freely control the transfer and stopping of the sheet in the paths 7 and 8, and at the switch-back section. And if necessary, the transfer therethrough can be changed in speed. This gives more degree of freedom in controlling. Of course, it is possible to arrange such that part or all of the driving sections are composed of a common driving section (part or all of the sheet transfer driving sections may be driven by a common driving section). This arrangement attains cost reduction in driving system. Moreover, by the arrangement in which, in accordance with the longest length of the sheets, the distances between rollers are so set that the sheets do not interfere with each other, the interference between sheets can be avoided if the sheets are transferred at a constant speed in any part of the apparatus.

Specifically, the present invention is preferably so arranged that the first sheet-transferring path includes switch-back means, located at an immediate upstream of the printed sheet storage section, the switch-back means transferring the one-side printed sheet to the second sheet-transferring path.

It is rational for such two-side image forming apparatus that two sheets are transferred concurrently in the overall sheet-transferring path.

Specifically, the two-side image forming apparatus is preferably so arranged as to include: (a) first image processing means for (i) transferring a first sheet via the first sheet-transferring path to the image transcribing section, the first sheet supplied from the unprinted sheet storage section, (ii) performing image processing (printing an image) on one side of the first sheet, (iii) transferring the first sheet to the switch back means, and (iv) reversing a transfer direction of the first sheet toward the second sheet-transferring path; (b) second image processing means for (v) transferring, to the second sheet-transferring path, the first sheet whose transfer direction is thus reversed by the switch-back means, the second image processing means, concurrently with (v), (I) transferring a second sheet via the first sheet-transferring path to the image transcribing section, the second sheet supplied from the unprinted sheet storage section, (II) performing image processing (printing an image) on one side of the second sheet, (III) transferring the second sheet to the switch back means, and (IV) reversing a transfer direction of the second sheet toward the second sheet-transferring path; (c) third image processing means for (V) transferring, to the second sheet-transferring path, the second sheet whose transfer direction is thus reversed by the switch-back means, the third image processing means, concurrently with (V), (vi) transferring from the second sheet-transferring path to the first sheet-transferring path, the first sheet that has been in the second sheet-transferring path, (vii) performing image processing (printing an image) on another side of the first sheet in the first sheet-transferring path, and (viii) transferring the first sheet to the printed sheet storage section via the switch-back section; and (d) fourth image processing means for (vi) transferring from the second sheet-transferring path to the first sheet-transferring path, the second sheet that has been in the second sheet-transferring path, (vii) performing image processing (printing an image) on another side of the second sheet in the first sheet-transferring path, and (viii) transferring the second sheet to the printed sheet storage section via the switch-back section. This arrangement is suitable for printing sheets in even numbers.

Moreover, in addition to the above arrangement, the two-side image forming apparatus is so arranged to further include fifth image processing means for ($\alpha$) transferring a third sheet from the unprinted sheet storage section to the first sheet-transferring path after the another side of the second sheet is image-processed by the fourth image processing means, ($\beta$) performing image processing (printing an image) on one side of the third sheet, ($\gamma$) transferring the third sheet from the first sheet-transferring path to the second sheet-transferring path by reversing a transfer direction of the third sheet by the switch-back means R3, ($\delta$) transferring the third sheet through the first sheet-transferring path again and performing image processing (printing an image) on another side of the third sheet, and ($\epsilon$) transferring the third sheet to the printed sheet storage section via the switch-back section. This arrangement is suitable for printing sheets in odd numbers.

Moreover, the above arrangement can be described as follows.

The two-side image forming apparatus of the present invention is preferably arranged such that the switch-back means reverses a transfer direction of a first sheet and transfers the first sheet into the second sheet-transferring path, path in a period in which a second sheet is supplied from the unprinted sheet storage section, the second sheet is transferred via the first transferring path, and a transfer direction of the second sheet is reversed, the second sheet being to be subjected to image processing after the first sheet. Further, the two-side image forming apparatus of the present invention is preferably arranged that the switch-back means reverses the transfer direction of the second sheet and transfers the second sheet into the second sheet-transferring path, in a period in which the first sheet which has been printed on its one surface is transferred through the second sheet-transferring path, the first sheet is printed on its reverse surface in the first sheet-transferring path and then, the first sheet is transferred to the printed sheet storage section. By repeating such operation more than once, it is possible to attains efficient image processing of sheets in even numbers.

Moreover, the two-side image forming apparatus may be so arranged that a third sheet that is to be processed after the operation, that is, after the second sheet, is solely transferred in the overall sheet-transferring path, after the second sheet is transferred to the printed sheet storage section, the second sheet having been transferred into the second sheet-transferring path, and printed on its reverse surface in the first sheet-transferring path. If sheets in odd numbers are to be printed, an efficient image processing can be attained by doing such operation at an end of printing.

Note that the two-side image forming apparatus may be so arranged that the first sheet-transferring path, the second sheet-transferring path, and the switch-back means respectively include sheet transfer driving sections, which are independently driven by different driving sources.

It is preferable that the two-side image forming apparatus of the present invention is so arranged as to include first sheet detection means in the first-sheet-transferring path, first sheet detection means for detecting whether a sheet is present or absent; and third sheet detection means near the switch-back means, the third sheet detection means for detecting whether a sheet is present or absent; and the sheet transfer driving sections of the first sheet-transferring path, the second sheet-transferring path, and the switch-back means being respectively driven in accordance with detection results of the first, second, and third sheet detection means.

As to a specific sheet detection means, the two-side image forming apparatus of the present invention is preferably arranged such that the first sheet detection means is located at an immediate upstream of the PS roller, the first sheet detection means stopping the PS roller in a predetermined timing, if the first sheet detection means detects that a sheet is passing at the immediate upstream of the PS roller while another sheet is being transferred in the overall sheet-transferring path.

Further, it is preferable that the second sheet detection means stops a sheet that the second sheet detection means detects, if the second sheet detection means detects the sheet is passing in the second sheet-transferring path; and rotation of the PS roller and transfer of the sheet in the second sheet-transferring path are resumed in a predetermined timing, when both of the first sheet detection means and the second sheet detection means detect sheets.

By arranging and operating the sheet detection means as such, it is possible to improve process efficiency of the two-side image forming apparatus, because it is possible to concurrently transfer the sheets without interference therebetween, one of the sheets being transferred from the unprinted sheet storage section via the main transferring path to the printed sheet storage section, and another of the sheets being transferred from the printed sheet storage section via the sub-transferring path to the main transferring path.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed:

1. A two-side image forming apparatus comprising:

a first sheet-transferring path, for use in one-side image formation, for transferring, to a printed sheet storage section via an image transcribing section, a sheet supplied from an unprinted sheet storage section;

a second sheet-transferring path, connected to the first sheet-transferring path, for supplying a turned-over one-side printed sheet to the image transcribing section, an intermediate roller provided along the second sheet-transferring path;

a resist roller for synchronizing a timing at which a sheet is transferred onto the first sheet-transferring path, and a controller controlling concurrent transfer of a plurality of sheets in an overall sheet-transferring path when performing two-side image forming operation, the overall sheet-transferring path including the first sheet-transferring path and the second sheet-transferring path, wherein the controller resumes a rotation of the intermediate roller and a rotation of the resist roller so that the intermediate roller and the resist roller start at the same time to transfer the sheets to the second sheet-transferring path and the first sheet-transferring path, respectively.

2. The two-side image forming apparatus as set forth in claim 1, wherein:

the first sheet-transferring path includes switch-back means, located at an immediate upstream of the printed sheet storage section, the switch-back means transferring the one-side printed sheet to the second sheet-transferring path.

3. The two-side image forming apparatus as set forth in claim 2, further comprising:

second sheet detection means in the second sheet-transferring path, the second sheet detection means for detecting the one-side printed sheet transferred into the second sheet-transferring path, the controller (i) stopping the one-side printed sheet that is detected, when the second sheet detection means detects the one-side printed sheet, and (ii) resuming transfer of the one-side printed sheet in a predetermined timing.

4. A two-side image forming apparatus comprising:

a first sheet-transferring path, for use in one-side image formation, for transferring, to a printed sheet storage section via an image transcribing section, a sheet supplied from an unprinted sheet storage section;

a second sheet-transferring path, connected to the first sheet-transferring path, for supplying a turned-over one-side printed sheet to the image transcribing section, an intermediate roller provided along the second sheet-transferring path;

a resist roller for synchronizing a timing at which a sheet is transferred onto the first sheet-transferring path, and a controller controlling the concurrent transfer of a plurality of sheets in an overall sheet-transferring path when performing two-side image forming operation, the overall sheet-transferring path including the first sheet-transferring path and the second sheet-transferring path, wherein the controller resumes a rotation of the intermediate roller and a rotation of the resist roller so that the intermediate roller and the resist roller start at the same time to transfer the sheets to the second sheet-transferring path and the first sheet-transferring path, respectively, and wherein the first sheet-transferring path includes switch-back means, located at an immediate upstream of the printed sheet storage section, the switch-back means transferring the one-side printed sheet to the second sheet-transferring path, wherein the resist roller is located at a crossing point between the second sheet-transferring path and that part of the first sheet-transferring path which is between the unprinted sheet storage section and the image transcribing section, wherein the controller adjusts a resuming timing for resuming the transfer of the sheet to the image transcribing section in order to adjust on which part of the sheet an image is to be transcribed by the image transcribing section.

5. The two-side image forming apparatus as set forth in claim 1, wherein:

two sheets are transferred concurrently in the overall sheet-transferring path.

6. The two-side image forming apparatus as set forth in claim 2, wherein:

the switch-back means reverses a transfer direction of a first sheet and transfers the first sheet into the second sheet-transferring path in a period in which a second sheet is supplied from the unprinted sheet storage section, the second sheet is transferred via the first transferring path, and a transfer direction of the second sheet is reversed, the second sheet being to be subjected to image processing after the first sheet.

7. The two-side image forming apparatus as set forth in claim 6, wherein:

the switch-back means reverses the transfer direction of the second sheet and transfers the second sheet into the second sheet-transferring path, in a period in which the first sheet which has been printed on its one surface is transferred through the second sheet-transferring path, the first sheet is printed on its reverse surface in the first sheet-transferring path and then, the first sheet is transferred to the printed sheet storage section.

8. The two-side image forming apparatus as set forth in claim 7, wherein:

a third sheet that is to be processed after the second sheet, is solely transferred in the overall sheet-transferring path, after the second sheet is transferred to the printed sheet storage section, the second sheet having been transferred into the second sheet-transferring path, and printed on its reverse surface in the first sheet-transferring path.

9. The two-side image forming apparatus as set forth in claim 4, wherein:

the second sheet detection means and the resist roller are located so that $L1 < L2$, where Li is a longest sheet length along the transferring direction the two-side image forming apparatus can deal with, and L2 is a distance from the second sheet detection means to the resist roller along the second sheet-transferring path.

10. The two-side image forming apparatus as set forth in claim 4, wherein:

the resist roller and the switch-back means are so located that Li <L3, where L1 is a longest sheet length along the transferring direction the two-side image forming apparatus can deal with, and L3 is a distance from the resist roller to the switch-back means along the first sheet-transferring path.

11. The two-side image forming apparatus as set forth in claim 4, wherein:

the first sheet-transferring path, the second sheet-transferring path, and the resist roller are so located that L1 <L4, where L1 is a longest sheet length along the transferring direction the two-side image forming apparatus can deal with, L4 is a distance, along the second sheet-transferring path, from (a) a crossing point between the second sheet-transferring path and the downstream part of the first sheet-transferring path with respect to the image transcribing section, to (b) the resist roller.

12. The two-side image forming apparatus as set forth in claim 2, wherein:

in case where sheets in an even number are to be printed, the switch-back means performs, once or plural times, such (i) operation as to reverse a transfer direction of the first sheet and transfer the first sheet into the second sheet-transferring path, in a period in which the second sheet is supplied from the unprinted sheet storage section, the second sheet is transferred via the first sheet-transferring path and then a transfer direction of the second sheet is reversed by the switch-back means, and such (ii) operation as to reverse the transfer direction of the second sheet and transfer the second sheet into the second sheet-transferring path, in a period in which a transfer direction of the first sheet is reversed, the first sheet is transferred through the second sheet transferring path, the first sheet is printed on its reverse surface in the first sheet-transferring path, and then the first sheet is transferred into the printed sheet storage section; and in case where sheets in an odd number are to be printed, the switch-back means performs the operation once or plural times, and then a third sheet that is transferred after the second sheet is solely transferred in the overall sheet-transferring path.

13. A two-side image forming apparatus comprising:

a first sheet-transferring path, for use in one-side image formation, for transferring, to a printed sheet storage section via an image transcribing section, a sheet supplied from an unprinted sheet storage section;

a second sheet-transferring path, connected to the first sheet-transferring path, for supplying a turned-over one-side printed sheet to the image transcribing section, an intermediate roller provided along the second sheet-transferring path;

a resist roller for synchronizing a timing at which a sheet is transferred onto the first sheet-transferring path, and a controller controlling concurrent transfer of a plurality of sheets in an overall sheet-transferring path when performing two-side image forming operation, the overall sheet-transferring path including the first sheet-transferring path and the second sheet-transferring path, wherein the controller resumes a rotation of the intermediate roller and a rotation of the resist roller so that the intermediate roller and the resist roller start at the same time to transfer the sheets to the second sheet-transferring path and the first sheet-transferring path, respectively, wherein the first sheet-transferring path includes switch-back means, located at an immediate upstream of the printed sheet storage section, the switch-back means transferring the one-side printed sheet to the second sheet-transferring path, wherein the first sheet-transferring path, the second sheet-transferring path, and the switch-back means respectively include sheet transfer driving sections, which are independently driven by different driving sources and controlled by the controller.

14. The two-side image forming apparatus as set forth in claim 13, further comprising:

first sheet detection means in the first-sheet-transferring path, first sheet detection means for detecting whether a sheet is present or absent;

second sheet detection means in the second sheet-transferring path, the second sheet detection means for detecting the one-side printed sheet transferred into the second sheet-transferring path; and third sheet detection means near the switch-back means, the third sheet detection means for detecting whether a sheet is present or absent, wherein the controller controls the sheet transfer driving sections of the first sheet-transferring path, the second sheet-transferring path, and the switch-back means being respectively driven in accordance with detection results of the first, second, and third sheet detection means.

15. The two-side image forming apparatus as set forth in claim 14, wherein:

the first sheet detection means is located at an immediate upstream of the resist roller, the controller stops the resist roller in a predetermined timing, if the first sheet detection means detects that a sheet is passing at the immediate upstream of the resist roller while another sheet is being transferred in the overall sheet-transferring path.

16. The two-side image forming apparatus as set forth in claim 15, wherein:

the controller stops a sheet that the second sheet detection means detects, if the second sheet detection means detects the sheet is passing in the second sheet-transferring path; and the controller resumes rotation of the resist roller and transfer of the sheet in the second sheet-transferring path in a predetermined timing, when both of the first sheet detection means and the second sheet detection means detect sheets.

17. A two-side image forming apparatus comprising:

a first sheet-transferring path, for use in one-side image formation, for transferring, to a printed sheet storage section via an image transcribing section, a sheet supplied from an unprinted sheet storage section;

a second sheet-transferring path, connected to the first sheet-transferring path, for supplying a turned-over one-side printed sheet to the image transcribing section, an intermediate roller provided along the second sheet-transferring path;

a resist roller for synchronizing a timing at which a sheet is transferred onto the first sheet-transferring path, a controller controlling concurrent transfer of a plurality of sheets in an overall sheet-transferring path when performing two-side image forming operation, the overall sheet-transferring path including the first sheet-transferring path and the second sheet-transferring path, the controller resuming a rotation of the intermediate roller and a rotation of the resist roller so that the intermediate roller and the resist roller start at the same time to transfer the sheets to the second sheet-transferring path and the first sheet-transferring path, respectively; and second sheet detection means in the second sheet-transferring path, the second sheet detection means for detecting the one-side printed sheet transferred into the second sheet-transferring path, wherein the controller (i) stops the one-side printed sheet that is detected, when the second sheet detection means detects the one-side printed sheet, and (ii) resumes transfer of the one-side printed sheet in a predetermined timing.

* * * * *